US005240435A

United States Patent [19]

Forbrook

[11] Patent Number: 5,240,435

[45] Date of Patent: Aug. 31, 1993

[54] ELECTRICAL SAFETY DEVICE

[75] Inventor: Randall L. Forbrook, Maple Grove, Minn.

[73] Assignee: Progressive Systems, Inc., Minneapolis, Minn.

[21] Appl. No.: 889,475

[22] Filed: May 27, 1992

Related U.S. Application Data

[63] Continuation of Ser. No. 765,530, Sep. 25, 1991, abandoned.

[51] Int. Cl.[5] ..... H01R 13/68

[52] U.S. Cl. ..... 439/621

[58] Field of Search ..... 337/211, 213; 439/621, 439/622

[56] References Cited

U.S. PATENT DOCUMENTS

| | | | |
|---|---|---|---|
| 2,072,729 | 3/1937 | Corbett | 337/211 X |
| 4,488,201 | 12/1984 | Webb et al. | 337/211 |
| 4,721,862 | 1/1988 | Cooper | 439/622 X |
| 4,924,345 | 5/1990 | Siemon et al. | 439/622 X |

*Primary Examiner*—Eugene F. Desmond
*Attorney, Agent, or Firm*—John L. Rooney

[57] ABSTRACT

An apparatus for protecting an operator or maintenance person from electrical shock when working near power distribution facilities. The device is characterized by easily snapping off for access to the electrical circuitry and easily snapping on again to afford the desired protection. The shield is transparent providing the operator with visual access to the electrical circuitry at all times, even when the protective device is in place. The apparatus contains a transparent insulative plate attached to a suitable number of insulative clips. In the preferred mode, these clips are positioned to snap onto cartridge type fuses in a multiphase fuse panel. When snapped in place, the clips hold the transparent insulative plate between the electrical circuitry and the operator or maintenance person. Test points are drilled through the transparent insulative plate at appropriate locations to provide for the insertion of test probes when the protective device is in place. An optional handle may be attached to the transparent insulative plate to assist in installation and removal. An alternative embodiment employs one or more skirts fixedly attached perpendicular to the insulative plate to provide further protection. To provide ease in manufacturing, all components may be molded as a single piece.

2 Claims, 8 Drawing Sheets

ELECTRICAL SAFETY DEVICE

This is a continuation of co-pending application Ser. No. 07/765,530 filed on Sept. 25, 1991, abandoned.

BACKGROUND OF THE INVENTION

1. Field of the Invention

The present invention generally relates to electrical safety apparatus and more particularly relates to a removable protection cover.

2. Description of the Prior Art

It is common in the design and fabrication of electrically operated devices to protect various electrical circuits using overcurrent protection fuses. For industrial applications involving a large number of heavy current, high voltage circuits, power distribution panels are used to accommodate the overcurrent protection fuses. U.S. Pat. No. 4,870,542 issued to Koslosky et al, shows an approach to a power distribution panelboard.

Holders for the individual fuses are concerned with obtaining low resistance contact between the fuse and the corresponding electrical circuit. U.S. Pat. No. 4,568,137 issued to Leuthold; U.S. Pat. No. 4,962,363 issued to Sexton; U.S. Pat. No. 4,968,264 issued to Ruehl et al; U.S. Pat. No. 4,872,262 issued to March; U.S. Pat. No. 4,941,851 issued to Hsueh; U.S. Pat. No. 4,944,691 issued to Marach; and U.S. Pat. No. 4,966,561 issued to Norden each describe a slightly different approach to apparatus for holding the various types of fuses.

A common concern, particularly when higher voltages are present in the circuit, is protection of the operator and maintenance personnel from contact with the electrically conductive portions of the fuse holder. Ordinarily this involves a device attached to the fuse holder which encases the entire fuse assembly. U.S. Pat. No. 4,938,715 issued to Jones et al, shows such a device. Because the cover attaches to the fuse block, it is a relatively complex structure which is only useful for the specific fuse block for which it is made.

U.S. Pat. No. 4,721,862 issued to Cooper shows an improved fuse cover which covers a number of fuses within a fuse block. Because of the attachment to the fuse block, however, the Cooper approach restricts use of the cover to the specific fuse block. A second problem with attachment to the fuse block is that the cover tends to constrict movement of cooling air. Particularly in high current electrical circuits, this may prove to be a problem. The solution of supplying cooling air to individual fuses tends to be complex and costly. U.S. Pat. No. 4,921,451 issued to Carlson uses a hinged cover. Note that it is also attached to the fuse holder and therefore has the above identified problems.

A fuse cover attached to the individual fuse is shown in U.S. Pat. No. 4,926,290 issued to Mizerak. The corresponding use of the fuse cover with a fuse holder is shown in U.S. Pat. No. 4,841,413 issued to Mizerak. Because the cover is attached to the fuse, it is useful with a wide range of fuse holders. However, like the covers attached to the fuse holder, the Mizerak cover encircles the fuse. Therefore, even though the ends of the cover are open, it tends to disturb air movement in any direction not longitudinal to the fuse. The fuse covers are individually placed over each fuse requiring all fuses to have a cover to provide adequate protection.

SUMMARY OF THE INVENTION

The present invention overcomes the disadvantages of the prior art by providing a fuse protection cover which attaches directly to the fuses rather than to the fuse holder. Therefore, the fuse protection cover is suitable for a variety of application involving various different kinds of fuses, numbers of fuses, and types of fuse holders.

A single protection cover of the present invention covers a number of fuses. In the preferred mode, all of the fuses within a given fuse holder are covered by a single protection cover. However, it is equally within the teachings found herein to cover less than all of the fuses within a holder or to cover fuses from different fuse holders using a single protection cover.

In accordance with the present invention, the basic fuse protection cover is a flat plate. Therefore, it tends not to interfere with the flow of cooling air in any direction parallel to the plane of the protection cover. Thus minimal impact is experienced by using the fuse protection cover within previously existing or previously designed systems.

Even though the fuse protection cover snaps on and off easily, it contains appropriately place test point holes through which maintenance personnel can obtain electrical access to the fuses for testing purposes without actually removing the fuse protection cover. This provides an added measure of safety and ease of use.

An optional handle may be attached to the fuse protection cover. This provides even greater ease of installation and removal. It also provides a greater degree of safety because it further isolates the maintenance person from the electrical circuitry.

An alternative embodiment of the present invention adds skirts to the sides of the flat plate. These skirts provide additional protection from inadvertent access of the electrical components from the side. These skirts, along with the clamps and the handle, may be molded as a single piece for ease of manufacture. Optional vents may be provided in the skirts to promote enhanced cooling air flow.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
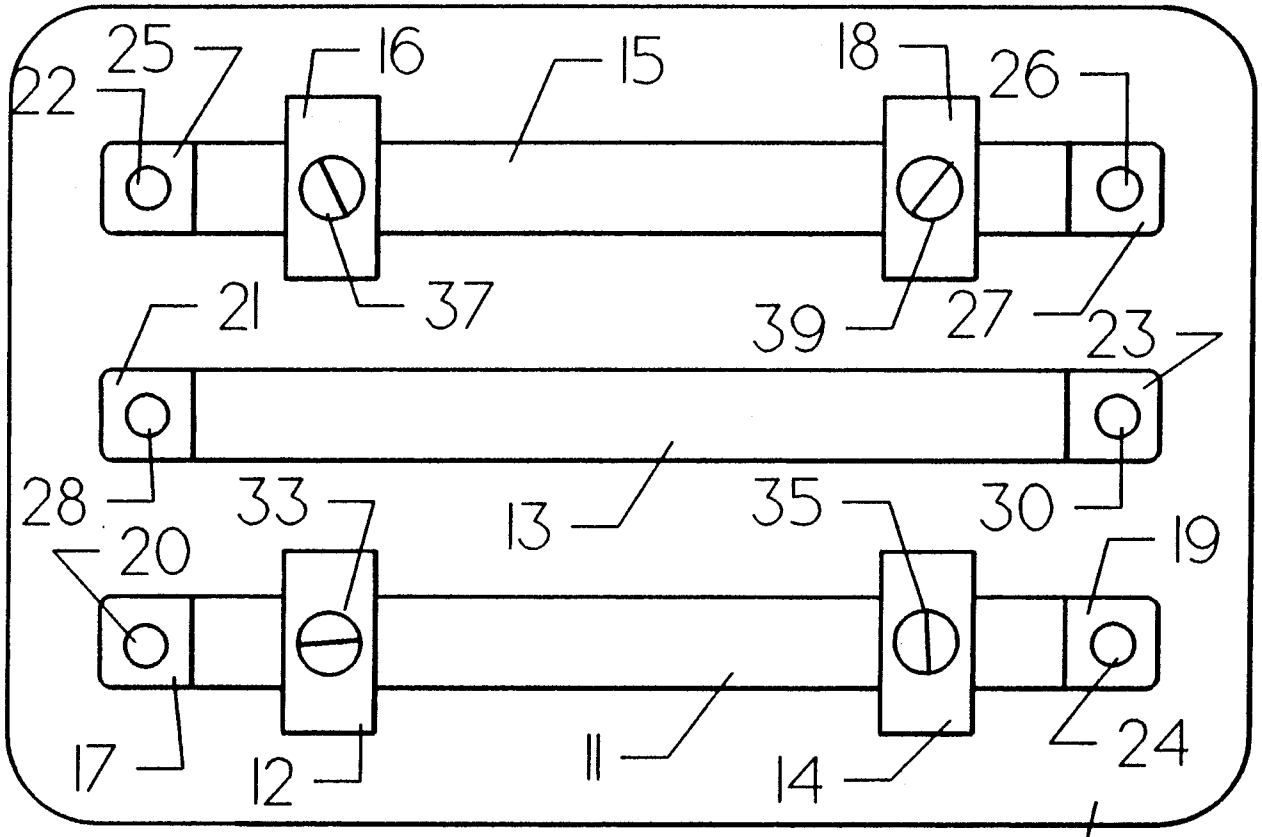
FIG. 1 is a plan view of a fuse protection cover in use according to the present invention.

FIG. 1 is a plan view of a fuse protection cover according to the present invention in use. By way of illustration and not to be construed as limiting of the present invention, the fuse protection cover is shown covering three standard cartridge type fuses.

Cartridge fuse 11, having conductive terminals 17 and 19, is shown as mounted in a standard fuse holder (not shown in this view). Similarly, fuse 13, having conductive terminals 21 and 23, along with fuse 15, having conductive terminals 25 and 27, are mounted and in operation. Note that fuses 11, 13, and 15 must be mounted substantially within the same plane but need not be mounted within the same fuse holder.

Interposed between fuses 11, 13, and 15 and the operating and maintenance personnel is insulative plate 10, which is preferably made of a single piece of transparent material, such as plexiglass, having a thickness of about ¼ inch. The corners of insulative plate 10 are preferably smoothly rounded as shown to further protect personnel in the area.

Insulative plate 10 is removably attached to fuse 11 by insulative clips 12 and 14 and to fuse 15 by insulative clips 16 and 18. Insulative clip 12 is attached to insulative plate 10 by screw 33. Similarly, insulative clips 14, 16, and 18 are attached to insulative plate 10 by screws 35, 37, and 39, respectively. Attachment of each insulative clip by a single screw is sufficient if the fastener is able to maintain adequate alignment between the insulative clip and insulative plate 10 during repeated installation and removal. An alternative is the use of a non-cylindrical or keyed fastener such as a rivet having a rectangular cross section applied within keyed holes having proper alignment.

To permit maintenance personnel to electrically access the fuses for test purposes with the fuse protection cover in place, test point holes 20, 22, 24, 26, 28, and 30 have been drilled to align with conductive terminals 17, 25, 19, 27, 21, and 23, respectively. Preferably and not by way of limitation of the present invention, these test point holes are approximately ⅛ inch in diameter. This is sufficient to provide easy access by a test probe without exposing personnel to an added risk of shock.

Figure 2:
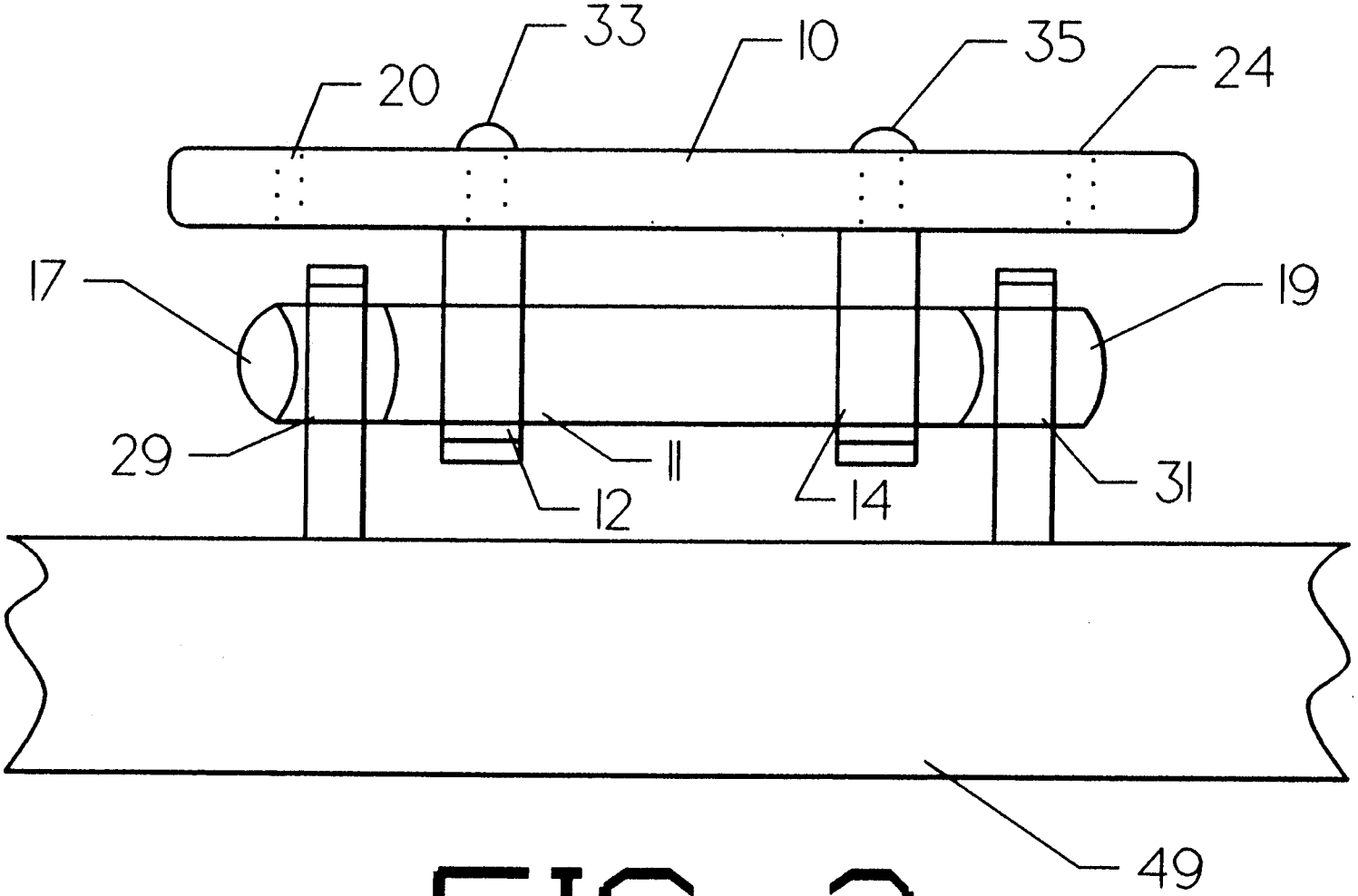
FIG. 2 is a side view showing attachment of the fuse protection cover to a fuse within a fuse holder.

FIG. 2 is a side view of the fuse protection cover of FIG. 1. Conductive terminal 17 of fuse 11 is electrically and mechanically coupled to conductive clip 29. Similarly, conductive terminal 19 is coupled to conductive clip 31. Conductive clips 29 and 31 are fixedly mounted on fuse holder substrate 49 as is well known in the art. This technique of mounting fuse 11 is considered illustrative only and should not be deemed to limit the present invention.

Insulative clips 12 and 14 partially encircle fuse 11 as shown. In this way, insulative plate 10 is held in place. All other referenced components are as previously described.

Figure 3:
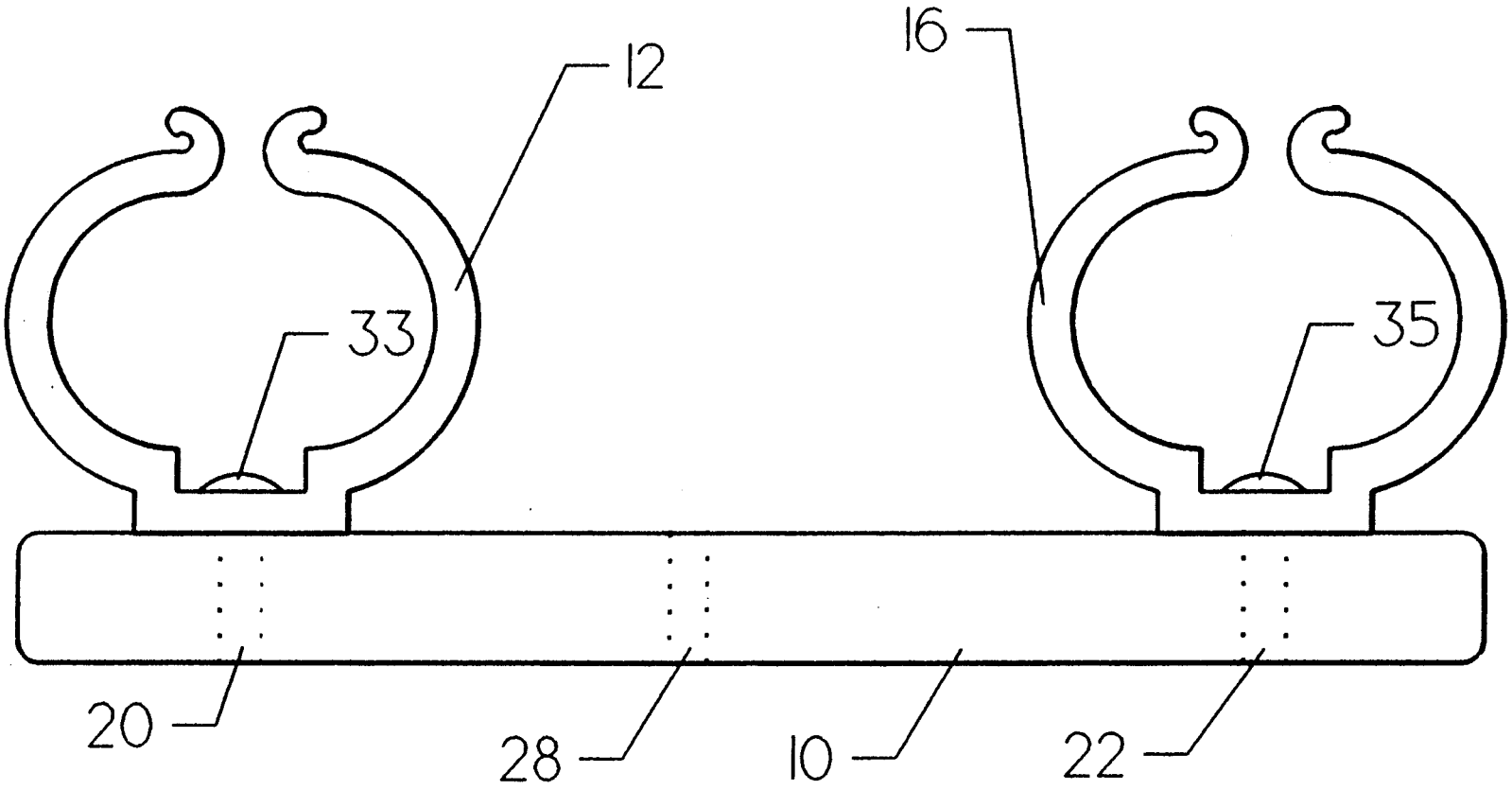
FIG. 3 is an end view of the fuse protection cover.

FIG. 3 is an end view of the fuse protection cover without the fuses or fuse holder(s). Insulative clips 12 and 16 are readily available commercial components. They are chosen with a convenient radius for snugly maintaining attachment to the respective fuses (see also FIG. 1) while providing easy manual detachment when desired. Other referenced components are as previously described.

Figure 4:
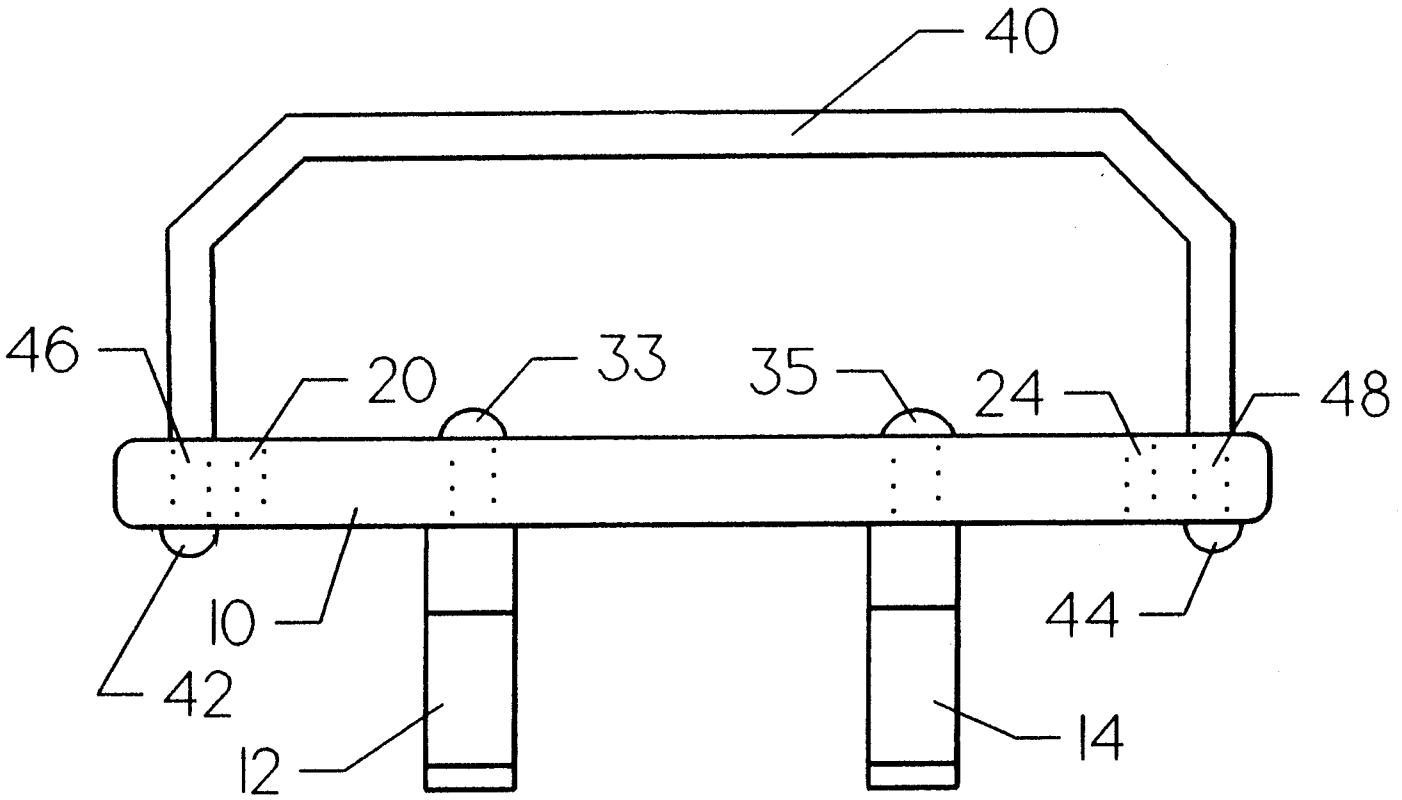
FIG. 4 is a side view of the fuse protection cover having an optional handle.

FIG. 4 is a side view of the fuse protection cover employing an optional handle. The handle member 40 is preferably molded of an insulative polymer. It is attached to insulative plate 10 by drilling holes 46 and 48 in insulative plate 10. Screws 42 and 44 are firmly attached to handle member 40 as shown. Handle member 40 is preferably mounted near the center of insulative plate 10. Other referenced components are as previously described.

Figure 5:
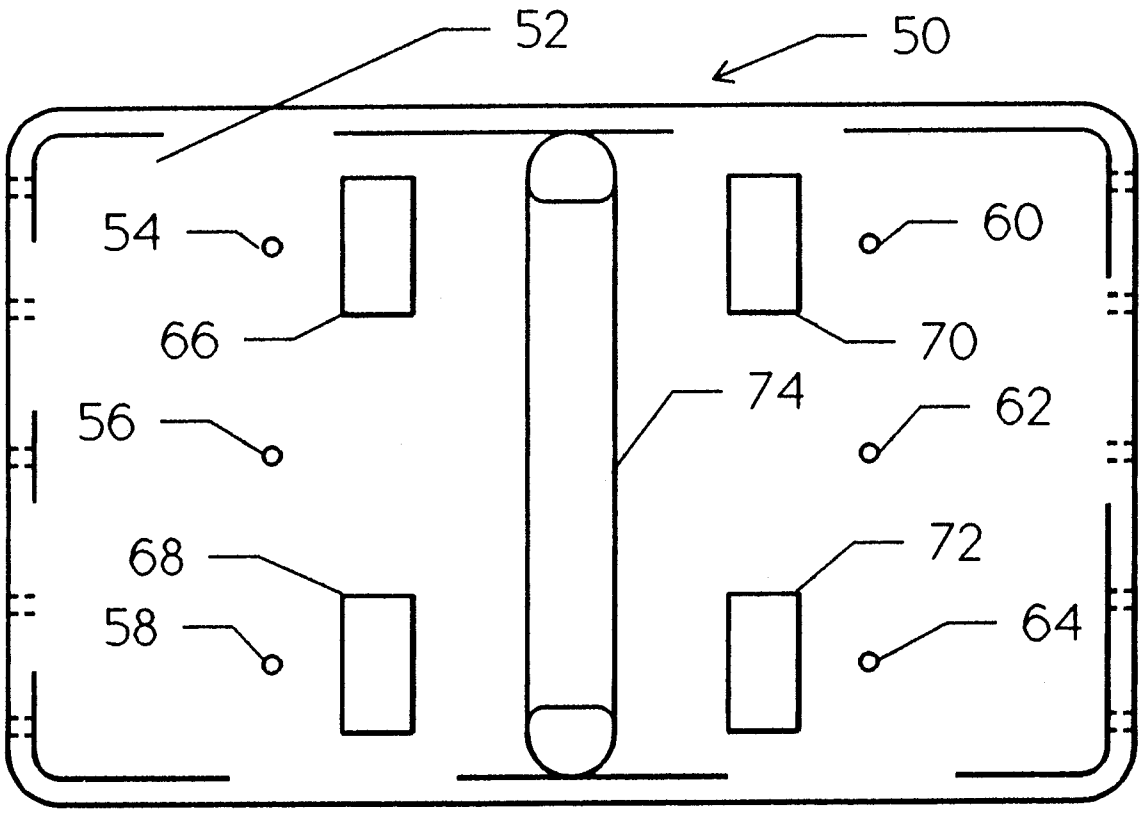
FIG. 5 is a top view of an alternative embodiment.

FIG. 5 is a top view of an alternative embodiment 50 of the present invention. In this approach, flat insulative plate 10 is replaced with a configured insulative plate 52 having side skirts as discussed in more detail below. Test point holes 54, 56, 58, 60, 62, and 64 function in the same manner as test point holes 20, 22, 24, 26, 28, and 30 as discussed in more detail above.

Handle 74 is molded as a single piece with configured insulative plate 52. Similarly, insulative clamps 66, 68, 70, and 72 are molded in the same operation.

Figure 6:
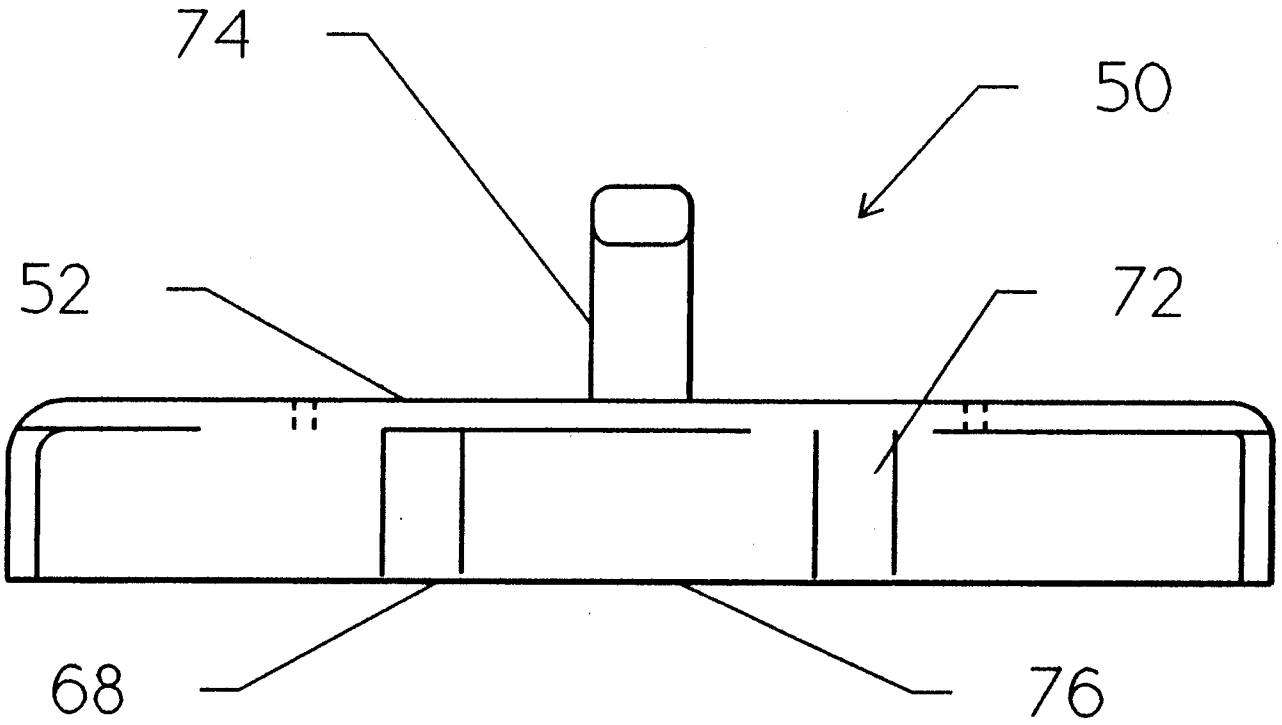
FIG. 6 is a side view of the embodiment of FIG. 5.

FIG. 6 is a side view of the alternative embodiment 50. Side skirt 76 is molded directly to configured insulative plate 52. Not shown in this view is opposing side skirt 78 on the opposite side of configured insulative plate 52. All other referenced elements are as previously described.

Figure 7:
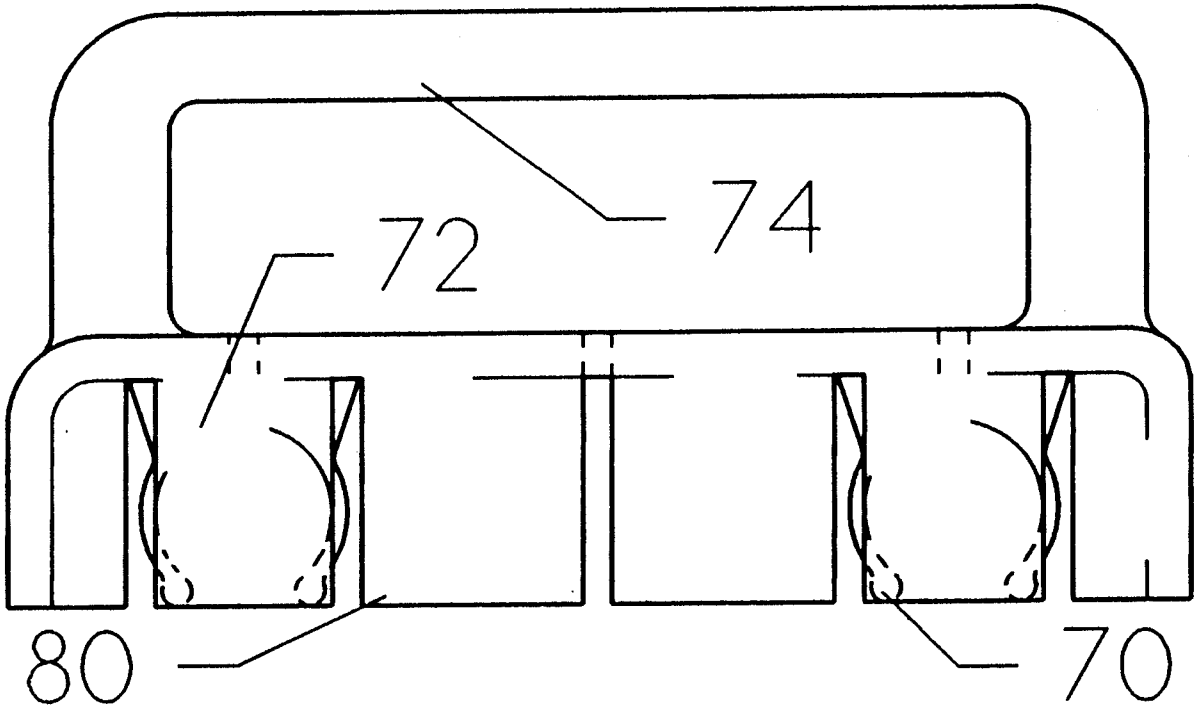
FIG. 7 is an end view of the embodiment of FIG. 5.

FIG. 7 is an end view of alternative embodiment 50. End skirt 80 is molded as a single piece along with configured insulative plate 52. Not shown in this view is opposing end skirt 82. To assist in the circulation of cooling air, end skirt 80, as well as one or more of the other skirts, may be slotted as shown. The remaining referenced elements are as previously described.

Figure 8:
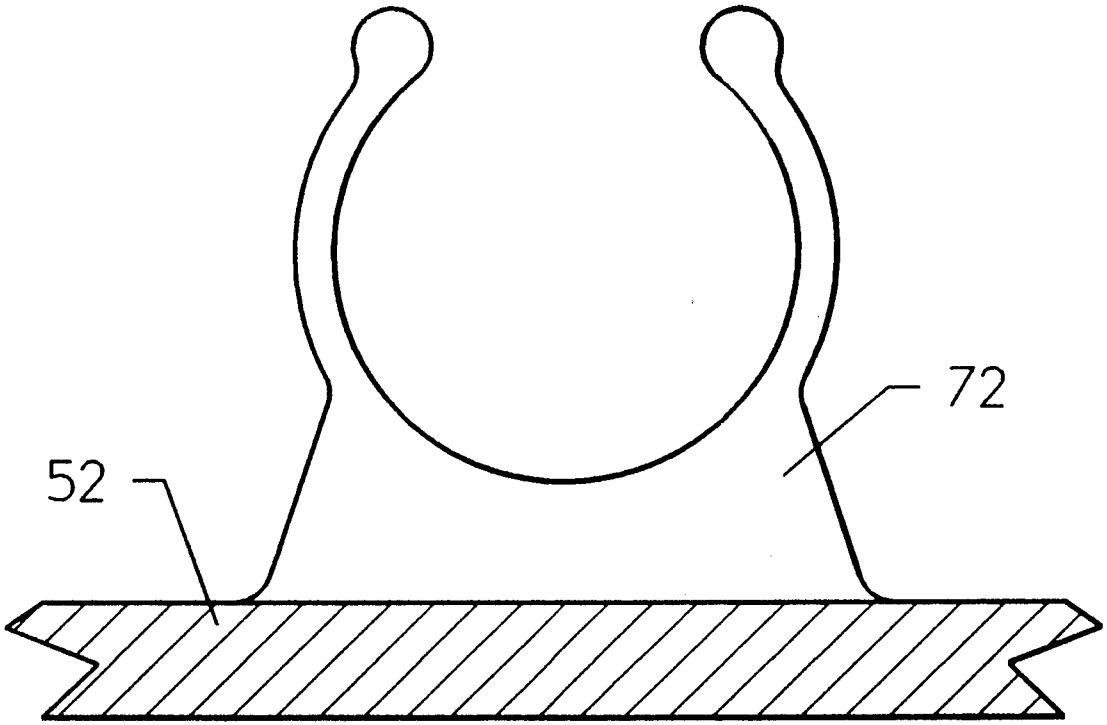
FIG. 8 is a close up partially sectioned view showing a molded clamp.

FIG. 8 is a partially sectioned close up view showing insulative clamp 72 as molded along with configured insulative plate 52. This construction technique permits the entire alternative embodiment 50 to be molded of a single piece of transparent but rigid polymer material.

Having thus described the preferred embodiments of the present invention, those of skill in the art will be readily able to make and use yet other embodiments within the scope of the claims hereto attached.

I claim:

1. An apparatus comprising:
   a. a fuse holder having a plurality of conductive clips;
   b. a plurality of fuses mechanically and electrically coupled to said fuse holder by means of said plurality of conductive clips;
   c. a plurality of insulative clips each having a convenient radius for snugly maintaining attachment to an insulative portion of one of said plurality of fuses while providing manual detachment by snapping off easily;
   d. an insulative plate fixedly coupled to said plurality of insulative clips;
   e. said insulative plate being transparent and having at least one test point;
   f. said at least one test point comprising at a least one test point for each of said plurality of fuses; and
   g. a skirt fixedly attached to said insulative plate.

2. An apparatus according to claim 1 wherein said skirt has means for assisting in circulation of cooling air.

* * * * *